US009372474B2

(12) United States Patent
Tassetti et al.

(10) Patent No.: US 9,372,474 B2
(45) Date of Patent: Jun. 21, 2016

(54) EXTERNAL PIECE FOR A TIMEPIECE AND SYSTEM OF MANUFACTURING THE SAME

(75) Inventors: Jean-Paul Tassetti, Orchamps-Vennes (FR); Gilles Derriey, Morteau (FR); Patrice Dumont, Villers-le-Lac (FR)

(73) Assignee: Comadur S.A., Le Locle (CH)

( * ) Notice: Subject to any disclaimer, the term of this patent is extended or adjusted under 35 U.S.C. 154(b) by 218 days.

(21) Appl. No.: 14/004,320

(22) PCT Filed: Feb. 17, 2012

(86) PCT No.: PCT/EP2012/052740

§ 371 (c)(1),
(2), (4) Date: Sep. 10, 2013

(87) PCT Pub. No.: WO2012/123214

PCT Pub. Date: Sep. 20, 2012

(65) Prior Publication Data

US 2013/0343165 A1 Dec. 26, 2013

(30) Foreign Application Priority Data

Mar. 16, 2011 (EP) ..... 11158456

(51) Int. Cl.

| | |
|---|---|
| ***G04B 39/00*** | (2006.01) |
| ***G04D 3/06*** | (2006.01) |
| ***B24B 13/00*** | (2006.01) |
| ***B24B 41/06*** | (2012.01) |
| ***B24B 13/06*** | (2006.01) |

(52) U.S. Cl.

CPC ..... *G04B 39/004* (2013.01); *B24B 13/00* (2013.01); *B24B 13/06* (2013.01); *B24B 41/06* (2013.01); *G04D 3/065* (2013.01)

(58) Field of Classification Search

CPC .. G04B 39/002; G04B 39/004; G04B 39/006; G04B 39/008; G04D 3/065; B24B 23/06; B24B 13/00; B24B 13/06; B24B 41/06

USPC ..... 368/296

See application file for complete search history.

(56) References Cited

U.S. PATENT DOCUMENTS

| | | | | | |
|---|---|---|---|---|---|
| D73,360 | S | * | 8/1927 | Kislinger | D10/132 |
| 4,038,783 | A | * | 8/1977 | Rosenthal | B24B 13/065 451/123 |
| 4,434,581 | A | * | 3/1984 | Spriggs | B24B 13/0025 451/173 |
| 4,637,734 | A | | 1/1987 | Gogniat | |
| 4,862,646 | A | * | 9/1989 | Briones | G02B 3/06 451/256 |
| 4,884,482 | A | * | 12/1989 | Council, Jr. | B24B 13/046 451/42 |

(Continued)

FOREIGN PATENT DOCUMENTS

| | | |
|---|---|---|
| EP | 0 168 010 | 1/1986 |
| EP | 2 228 694 | 9/2010 |

(Continued)

OTHER PUBLICATIONS

International Search Report Issued Apr. 12, 2012 in PCT/EP12/052740 Filed Feb. 17, 2012.

*Primary Examiner* — Vit W Miska

(74) *Attorney, Agent, or Firm* — Oblon, McClelland, Maier & Neustadt, L.L.P.

(57) ABSTRACT

An external piece for a time piece and a method of manufacturing the same, including a top surface and a bottom surface. At least one of the faces includes a longitudinal curvature and a transverse curvature that are different.

13 Claims, 3 Drawing Sheets

(56) References Cited

U.S. PATENT DOCUMENTS 5,107,628 A * 4/1992 Kondo ..... B24B 13/06 451/10
5,231,587 A * 7/1993 Frost ..... B24B 13/06 451/390
5,711,696 A * 1/1998 Maeda ..... B24B 13/06 451/10
5,748,482 A * 5/1998 Nishimura ..... B24B 13/06 451/42
5,967,879 A * 10/1999 Gottschald ..... B24B 49/04 451/10
6,334,681 B1 * 1/2002 Perrott ..... G02C 7/02 351/159.01
6,406,769 B1 * 6/2002 Delabre ..... B24B 1/04 368/276
6,478,658 B1 * 11/2002 Logan ..... B24B 13/0031 451/11
7,038,976 B2 * 5/2006 Winkler ..... G04G 9/0041 362/23.15
7,083,326 B2 * 8/2006 Ast ..... G04B 39/008 368/223
7,134,752 B2 * 11/2006 Perrott ..... G02C 7/02 351/159.01
7,765,903 B2 * 8/2010 Schorcht ..... B24B 13/00 82/1.11
8,118,642 B2 * 2/2012 Coulon ..... B24B 1/00 451/123
2009/0223437 A1 * 9/2009 Ballard ..... G01D 7/00 116/288
2012/0329372 A1 * 12/2012 Tassetti ..... B24B 9/085 451/177

FOREIGN PATENT DOCUMENTS

JP 2-53557 A 2/1990
WO 98 15876 4/1998

* cited by examiner

B-B

A-A

C-C

EXTERNAL PIECE FOR A TIMEPIECE AND SYSTEM OF MANUFACTURING THE SAME

CROSS-REFERENCE TO RELATED APPLICATIONS

This is a National phase application in the United States of International patent application PCT/EP2012/052740 filed Feb. 17, 2012, which claims priority on European patent application No. 11158456.1 filed on Mar. 16, 2011. The entire disclosures of the above patent applications are hereby incorporated by reference.

FIELD OF THE INVENTION

The invention relates to an external piece for a timepiece and the system of manufacturing the same.

BACKGROUND OF THE INVENTION

It is known to form sapphire watch crystals which are highly scratch resistant. These crystals are generally manufactured by placing a rotating grinding wheel in contact against the surface of a drum carrying several crystals. The resulting grinding operation enables a cylindrical or spherical crystal to be formed. However, it becomes necessary to form asymmetrical crystals to be fitted, for example, to timepiece displays which are not centred with respect to the timepiece case, which is not possible using current series manufacturing techniques.

SUMMARY OF THE INVENTION

It is an object of the present invention to overcome all of part of aforecited drawbacks by proposing a new manufacturing system allowing the series manufacture of special crystals, whose longitudinal curvatures are independent of the transverse curvatures.

The invention therefore relates to a system of manufacturing an external piece for a timepiece comprising a securing device including a drum, rotatably mounted along a first axis, and carrying at least one blank of said piece, a machining device comprising abrasive means rotatably mounted along a second axis and intended to machine said at least one blank in order to form a first curvature, characterized in that the machining device further includes a means of moving said second axis so that the device is movably mounted along a curved directrix to selectively form a second curvature in said at least one blank and in that said first axis and said second axis are perpendicular so that the machining lines intersect.

It is therefore clear that at least one of the curvatures of the external piece is formed directly by the selective movement, i.e. totally free and controlled, of the axis of rotation of the abrasive means. Consequently, it becomes possible to series manufacture very complex crystals with an advantageous reject rate while facilitating a subsequent polishing step.

In accordance with other advantageous features of the invention:

- the directrix of the means of movement is symmetrical so as to form said second curvature on a single radius;
- the directrix of the means of movement is asymmetrical so as to form said second curvature on several radii;
- according to a first embodiment, the drum is a ring, against the inner wall of which said at least one blank is secured and the abrasive means is moved in the hollow of said ring so as to form first and second concave curvatures;

- according to a second embodiment, the drum is a disc, against the external wall of which at least one blank is secured and the abrasive means is moved in front of said disc so as to form first and second concave curvatures;
- the abrasive means is formed by a grinding wheel;
- according to a first variant, the means of movement is formed by an actuator moved back-and-forth against the profile of a fixed cam corresponding to said second curvatures;
- according to a second variant, the means of movement is formed by an automated device programmed to move along said second curvature;
- said piece is formed from crystalline alumina.

Further, the invention relates to an external piece comprising a top surface and a bottom surface, characterized in that at least one of the faces has a longitudinal curvature and a transverse curvature which are different and in that at least one of said longitudinal and transverse curvatures is asymmetrical.

It is therefore clear that the external piece may be complex and may, for example, form an asymmetrical crystal or a crystal whose contour visually appears asymmetrical, to be fitted for example to timepiece displays which are not centred relative to the timepiece case.

In accordance with other advantageous features of the invention:

- the bottom and top surfaces include a longitudinal curvature and a transverse curvature which are different;
- the external piece is formed from crystalline alumina.

Finally, the invention relates to a timepiece, characterized in that it includes an external piece according to any of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

The invention relates to a non-symmetrical, external piece such as a crystal, case or dial made of crystalline alumina-based material, such as sapphire, corundum or ruby. In order to make these new pieces, new manufacturing systems have been developed to be adapted, for example, to timepiece displays which are not centred relative to the timepiece case. By way of example, the case may be substantially in the form of a tear drop and/or non planar, requiring an off-centre display to be provided in order to harmonise the timepiece.

Naturally, although the invention was developed for the field of horology, it is not limited thereto. Other applications may also be envisaged such as optics, tableware or electronics.

Figure 1:
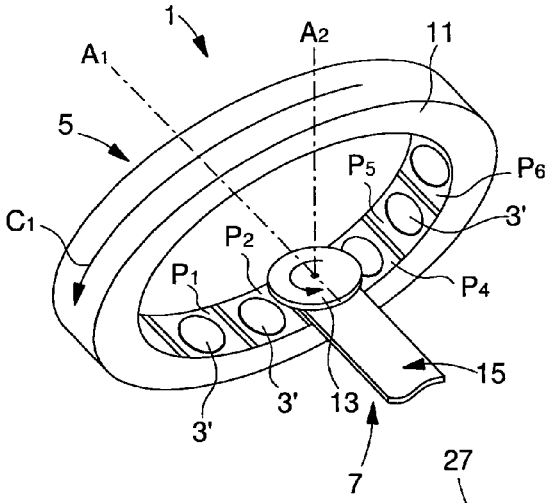
FIG. 1 is a view of a manufacturing system according to a first embodiment of the invention.

According to a first embodiment illustrated in FIG. 1, a manufacturing system 1 has been developed in order to produce external pieces 3 comprising surfaces whose curvatures $C_1$, $C_2$ are concave. Manufacturing system 1 includes a securing device 5 and a machining device 7.

Securing device 5 includes a drum 11, rotatably mounted along a first axis A1, and carrying at least one blank 3' of the future piece 3. Preferably, as seen in FIG. 1, drum 11 is a ring comprising a facetted inner wall, i.e. provided with successive planes $P_x$. As illustrated in FIG. 1, each successive plane $P_x$ receives a blank 3' which may be secured, for example, by bonding.

Machining device 7 includes an abrasive means 13 which is rotatably mounted along a second axis $A_2$ and which is intended to machine each blank 3'. Preferably, abrasive means 13 is moved in the hollow of ring-shaped drum 11. The abrasive means 13 shown in FIG. 1 is formed by a conventional grinding wheel, i.e. whose contact area does not have any particular shape. Of course, abrasive means 13 may be different and, for example, take the form of a curved or conical sabot.

Advantageously according to the invention, the machining device 7 includes a means 15 of moving the second axis $A_2$ so that said device is movably mounted along a curved directrix $C_2$ to selectively form a second curvature in each blank 3'. It is thus clear that manufacturing system 1 can form first and second concave curvatures $C_1$, $C_2$.

According to the invention, means of movement 15 may be, in a non-limiting manner, formed by an actuator moved back-and-forth against the profile of a fixed cam corresponding to the second curvature $C_2$ or, for example, an automated device programmed to move along said second curvature.

Thus, the first curvature $C_1$ is generated perpendicular to axis $A_1$ by the radius extending between axis $A_1$ and the contact area between abrasive means 13 and each blank 3'. Since drum 11 is moved in rotation along axis $A_1$, each blank 3' is thus hollowed out transversely along a single radius forming the first concave curvature $C_1$.

Moreover, advantageously according to the invention, the second curvature $C_2$ is directly obtained by selectively moving the second axis $A_2$. Thus while the first curvature $C_1$ is being generated, the contact area between abrasive means 13 and each blank 3' is gradually moved relative to the thickness of ring-shaped drum 11. Consequently, each blank 3' is hollowed out longitudinally along a curved directrix forming the second concave curvature $C_2$.

It is therefore immediately clear that the curved directrix of means of movement 15 may or may not be symmetrical in order to form the second curvature $C_2$ on one or several radii.

Finally, preferably according to the invention, the first axis $A_1$ and the second axis $A_2$ are perpendicular so that the machining lines intersect. This feature advantageously facilitates the subsequent polishing of external pieces 3.

Figure 2:
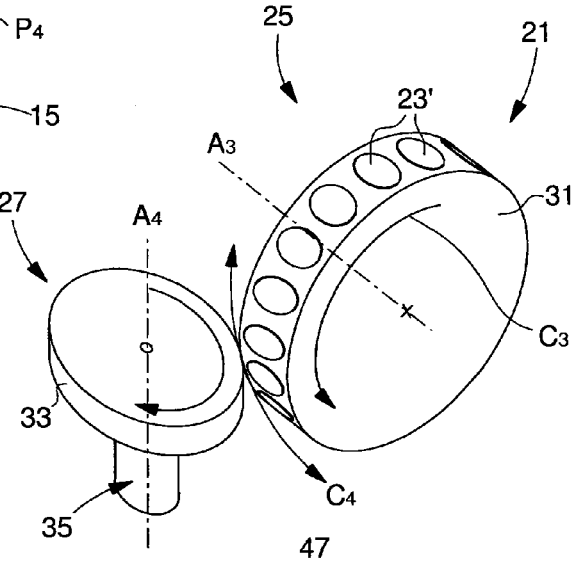
FIGS. 2 to 4 are views of a manufacturing system according to a second embodiment of the invention.
Figure 3:
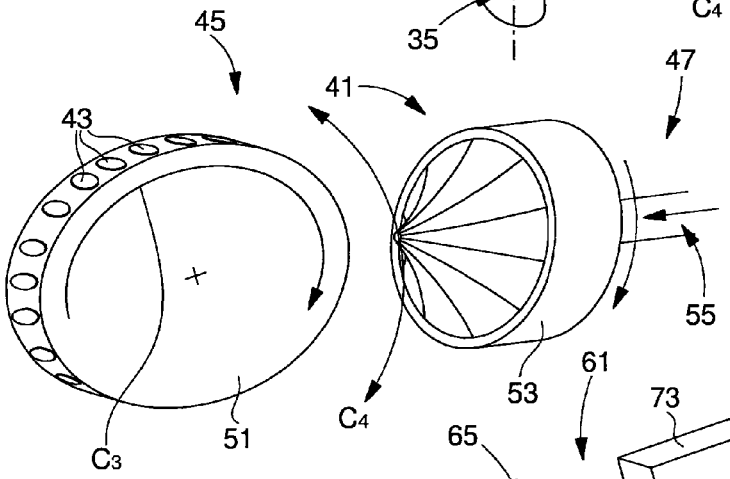
Figure 4:
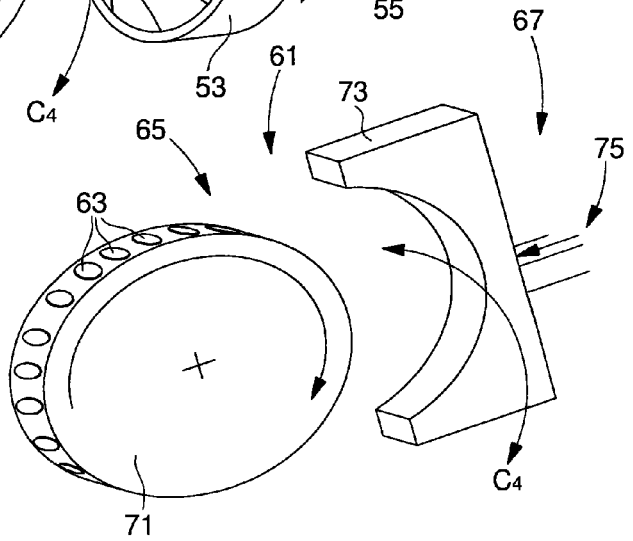

According to a second embodiment illustrated in FIGS. 2 to 4, a manufacturing system 21 has been developed to form external pieces 23 comprising surfaces whose curvatures $C_3$, $C_4$ are convex. Manufacturing system 21 includes a securing device 25 and a machining device 27.

Securing device 25 includes a drum 31, rotatably mounted along a first axis $A_3$, and carrying at least one blank 23' of the future piece 23. Preferably, as seen in FIG. 2, drum 21 is a disc, against the external wall of which each blank 23' is secured, for example, by bonding.

Machining device 27 includes an abrasive means 33 which is rotatably mounted along a second axis $A_4$ and which is intended to machine each blank 23'. Preferably, abrasive means 33 is moved in front of drum 31. The abrasive means 33 shown in FIG. 2 is formed by a conventional grinding wheel, i.e. whose contact area does not have any particular shape. Of course, abrasive means 33 may be different and, for example, take the form of a curved or conical sabot, as will be explained below.

Advantageously according to the invention, the machining device 27 includes a means 35 of moving the second axis $A_4$ so that said device is movably mounted along a curved directrix $C_4$ to selectively form a second curvature in each blank 23'. It is thus clear that manufacturing system 21 can form first and second convex curvatures $C_3$, $C_4$.

According to the invention, means of movement 35 may be, in a non-limiting manner, formed by an actuator moved back-and-forth against the profile of a fixed cam corresponding to the second curvature $C_4$ or, for example, an automated device programmed to move along said second curvature.

Thus, the first curvature $C_3$ is generated perpendicular to axis $A_3$ by the radius extending between axis $A_3$ and the contact area between abrasive means 33 and each blank 23'. Since drum 31 is moved in rotation along axis $A_3$, each blank 23' is thus hollowed out transversely on a single radius forming the first convex curvature $C_3$.

Moreover, advantageously according to the invention, the second curvature $C_4$ is directly obtained by selectively moving the second axis $A_4$. Thus while the first curvature $C_3$ is being generated, the contact area between abrasive means 33 and each blank 23' is gradually moved relative to the thickness of ring-shaped drum 31. Consequently, each blank 23' is hollowed out longitudinally along a curved directrix forming the second convex curvature $C_4$.

It is therefore immediately clear that the curved directrix of means of movement 35 may or may not be symmetrical in order to form the second curvature $C_4$ on one or several radii.

Finally, preferably according to the invention, the first axis $A_3$ and the second axis $A_4$ are perpendicular so that the machining lines intersect. This feature advantageously facilitates the subsequent polishing of external pieces 23. Polishing may, for example, be performed using securing and machining devices close to the securing device 25 and machining device 27 forming the blank of piece 23 explained above. However, since a polishing step is much less aggressive as regards the thickness to be removed, it is mainly only the abrasive means which is modified.

Thus, two polishing examples are shown in FIGS. 3 and 4. According to a first alternative of the second embodiment illustrated in FIG. 3, a manufacturing system 41 has been developed to polish external pieces 43 including surfaces whose curvatures $C_3$, $C_4$ are convex. Manufacturing system 41 includes a securing device 45 and a machining device 47.

Securing device 45 includes a rotatably mounted drum 51 which carries at least one piece 43 to be polished. Machining device 47 includes rotatably mounted abrasive means 53 designed to polish each piece 43. Preferably, abrasive means 53 is moved in front of drum 51. The abrasive means 53 shown in FIG. 3 is preferably formed by a conical sabot, for example made of metal, regularly coated with a liquid polish. Of course, other types of abrasive means such as a substantially flat means may also be suitable.

Advantageously according to the invention, machining device 47 includes a movement and pressing means 55 in order to force abrasive means 53 to rub against each piece 43 in order to polish said pieces selectively along second curvature $C_4$. It is therefore clear that manufacturing system 41 polishes first and second convex curvatures $C_3$, $C_4$.

According to the invention, means of movement 55 may, in a non-limiting manner, be formed by an actuator moved back-and-forth against the profile of a fixed cam corresponding to the second curvature $C_4$ or, for example, an automated device programmed to move along said second curve.

According to a second alternative of the second embodiment illustrated in FIG. 4, a manufacturing system 61 has been developed to polish external pieces 63 comprising surfaces whose curvatures $C_3$, $C_4$ are convex. Manufacturing system 61 includes a securing device 65 and a machining device 67.

Securing device 65 includes a rotatably mounted drum 71 which carries at least one piece 63 to be polished. Machining device 67 includes abrasive means 73 designed to polish each piece 63. Preferably, abrasive means 73 is moved in front of drum 71. The abrasive means 73 shown in FIG. 4 is preferably formed by a curved sabot, for example made of metal, regularly coated with a liquid polish.

Advantageously according to the invention, machining device 67 includes a movement and pressing means 75 in order to force abrasive means 73 to rub against each piece 63 in order to polish said pieces selectively along second curvature $C_4$. It is therefore clear that manufacturing system 61 polishes first and second convex curvatures $C_3$, $C_4$.

According to the invention, means of movement 75 may, in a non-limiting manner, be formed by an actuator moved back-and-forth against the profile of a fixed cam corresponding to the second curvature $C_4$ or, for example, an automated device programmed to move along said second curvature.

These first and second embodiments and their variants may be used alone or in combination. Consequently, a great variety of external pieces may be obtained according, in particular, to whether the top surface and/or bottom surface thereof is machined. It is however clear that, advantageously according to the invention, at least one of the top and bottom faces may include a longitudinal curvature and a transverse curvature which are different.

Moreover, depending upon the orientation of each piece 3', 23', 43, 63 relative to securing devices 5, 25, 45, 65, at least one of said longitudinal and transverse curvatures may be symmetrical or asymmetrical. It is therefore clear that this type of non symmetrical external piece may perfectly well form a crystal, case or dial made of crystalline alumina-based material, such as sapphire, corundum or ruby, for example, for a timepiece.

Two variant pieces 83, 103 forming timepiece crystals which can be made according to the invention are shown in FIGS. 5-7 and 8-10. According to the first variant, the external piece 83 includes a top surface 82 and a bottom surface 84 which are machined to obtain a substantially constant thickness $e_1$ despite the complex shape of piece 83.

Figure 5:
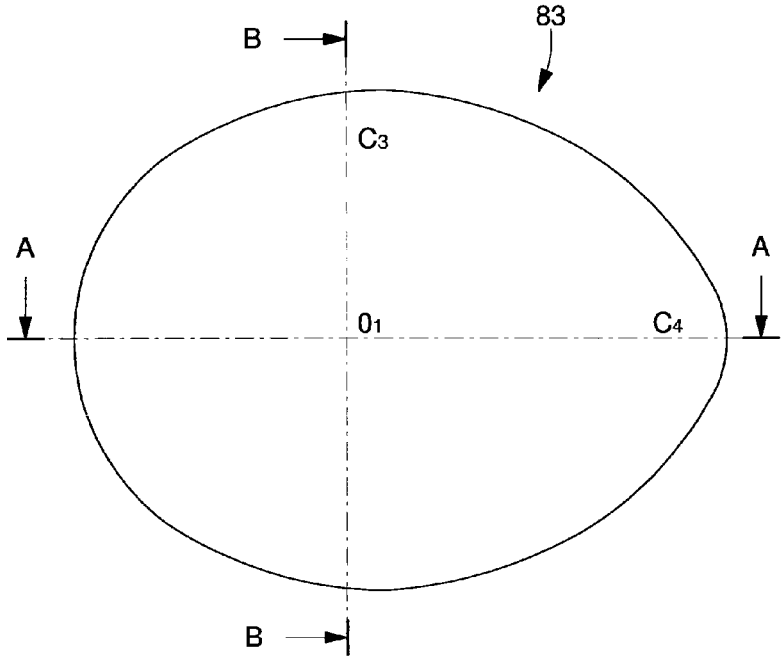
FIGS. 5 to 7 are diagrams of an external piece according to a first variant of the invention.

Thus FIG. 5 is a top view of the substantially ovoid piece 83. The longitudinal curvature $C_4$ is secant to the transverse curvature $C_3$ at point $O_1$. It will be noted that point $O_1$ is not centred with respect to the substantially ovoid shape but is closer to the flared part than to the pointed part. This configuration of piece 83, when added to a timepiece case, visually enhances the off-centre integration of the timepiece display.

Figure 6:
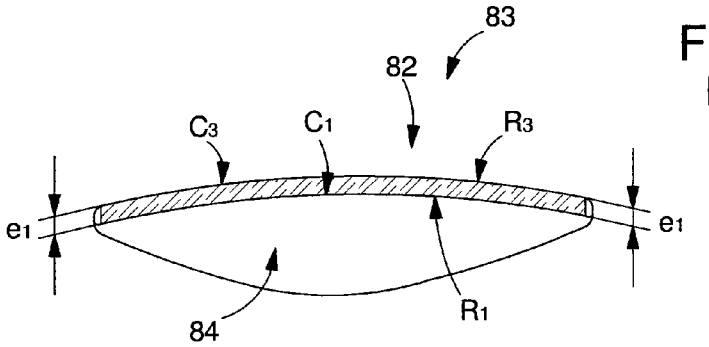
Figure 7:
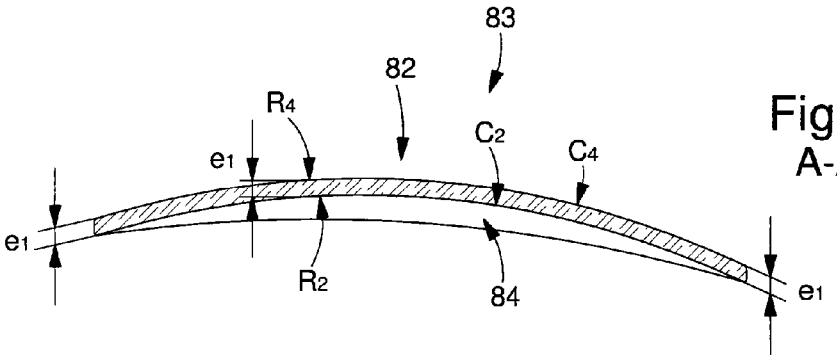

As visible in FIG. 7 showing the cross-section A-A of FIG. 5, i.e. a longitudinal cross-section, it is seen that curvatures $C_2$ and $C_4$ are parallel. In the example of FIGS. 5 to 7, it is to be noted that curvatures $C_2$ and $C_4$ in fact respectively form a single radius $R_2$ and $R_4$ so that $R_4=R_2+e_1$.

Likewise, as visible in FIG. 6 showing the cross-section B-B of FIG. 5, i.e. a transverse cross-section, it is seen that curvatures $C_1$ and $C_3$ are parallel. In the example of FIGS. 5 to 7, it is to be noted that curvatures $C_1$ and $C_3$ in fact respectively form a single radius $R_1$ and $R_3$ so that $R_3=R_1+e_1$.

Consequently, piece 83 is very curved and may, for example, form a crystal which appears visually asymmetrical to be fitted, for example, to timepiece displays which are not centred with respect to the timepiece case.

According to a second variant, the external piece 103 includes a top surface 102 and a bottom surface 104 wherein only the top surface is machined to obtain a substantially constant thickness $e_2$ on the edges thereof despite the complex shape of piece 103.

Figure 9:
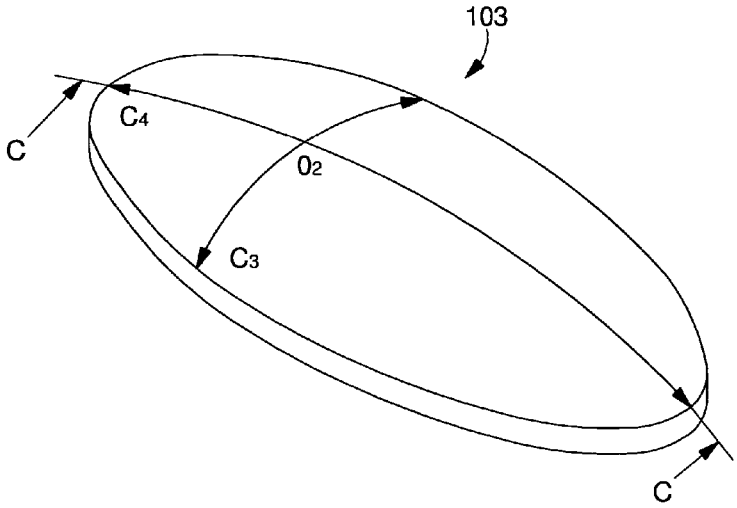

Thus, FIG. 9 is a perspective view of the substantially ovoid piece 103. The longitudinal curvature $C_4$ is secant to the transverse curve $C_3$ at point $O_2$. It will be noted that point $O_2$ is not centred with respect to the substantially ovoid shape but is closer to the flared part than to the pointed part. This configuration of piece 103, when added to a timepiece case, visually enhances the off-centre integration of the timepiece display.

Figure 8:
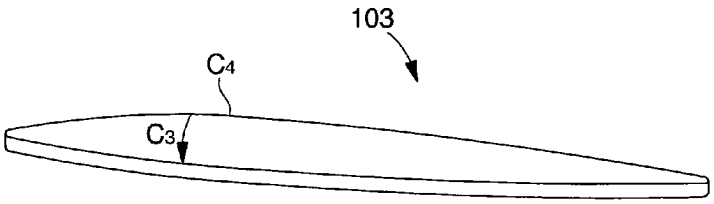
FIGS. 8 to 10 are diagrams of an external piece according to a second variant of the invention.
Figure 10:
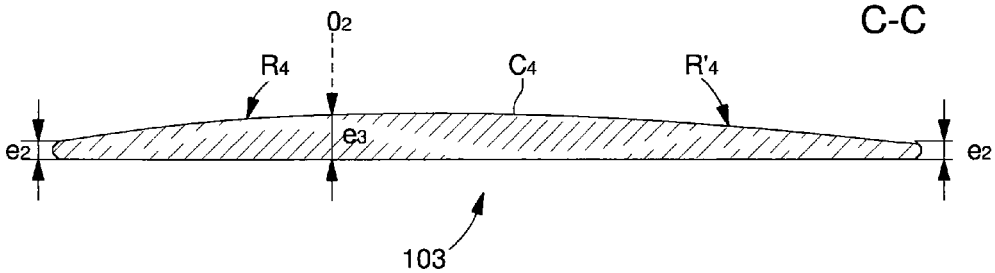

As visible in FIG. 10 showing the cross-section C-C of FIG. 9, i.e. a longitudinal cross-section, it is seen that curvature $C_4$ is asymmetrical. In the example of FIGS. 8 to 10, it is to be noted that curvature $C_3$ in fact forms a single radius $R_3$ and that curve $C_4$ forms two adjacent radii $R_4$ and $R'_4$. Thus, radius $R_4$ comprised between the edge of the flared part and point $O_2$ is greater than the radius $R'_4$ comprised between the edge of the pointed part and point $O_2$.

Consequently, piece 103 is very complex and may, for example, form an asymmetrical crystal to be fitted, for example, to timepiece displays which are not centred with respect to the timepiece case. In this regard, the maximum thickness $e_3$ of piece 103 is located plumb with imaginary point $O_2$ and the minimum thickness $e_2$ all around the edge of piece 103.

Of course, this invention is not limited to the illustrated example but is capable of various variants and alterations that will appear to those skilled in the art. In particular, other variant pieces may be envisaged according to whether the top face and/or the bottom face are machined with one or several radii both transversely and longitudinally.

The invention claimed is:

1. A system of manufacturing an external piece for a timepiece comprising:

a securing device including a drum, rotatably mounted along a first axis, and an inner circumferential wall or an outer circumferential wall of the drum carrying at least one blank of the piece; and a machining device comprising an abrasive structure rotatably mounted along a second axis and configured to machine the at least one blank to form a first curvature, wherein the machining device further includes a mechanism to move the second axis so that the machining device is movably mounted along a curved directrix to selectively form a second curvature in the at least one blank while the machining device is machining the first curvature, and wherein the first axis and the second axis are perpendicular so that machining lines intersect.

2. The system according to claim 1, wherein the directrix of the mechanism to move the second axis is symmetrical to form the second curvature on a single radius.

3. The system according to claim 1, wherein the directrix of the mechanism to move the second axis is asymmetrical to form the second curvature on plural radii.

4. The system according to claim 1, wherein the drum is a ring against the inner circumferential wall of which the at least one blank is secured, and wherein the abrasive structure is moved in a hollow of the ring to form first and second concave curvatures.

5. The system according to claim 1, wherein the drum is a disc against the outer circumferential wall of which the at least one blank is secured, and wherein the abrasive structure is moved in front of the disc to form first and second convex curvatures.

6. The system according to claim 1, wherein the abrasive structure includes a grinding wheel.

7. The system according to claim 1, wherein the mechanism to move the second axis includes an actuator moved back-and-forth against a profile of a fixed cam corresponding to the second curvature.

8. The system according to claim 1, wherein the mechanism to move the second axis includes an automated device programmed to move along the second curvature.

9. The system according to claim 1, wherein the piece is formed from crystalline alumina.

10. The system according to claim 1, wherein the at least one blank is secured on the outer circumferential wall of the drum.

11. The system according to claim 1, wherein the at least one blank is secured on the inner circumferential wall of the drum.

12. The system according to claim 1, wherein the inner circumferential wall of the drum is facetted.

13. The system according to claim 1, wherein the inner circumferential wall or the outer circumferential wall of the drum carries the at least one blank of at least one of a crystal, a case, and a dial for the timepiece.

* * * * *